United States Patent [19]

Kearns

[11] Patent Number: 4,513,589

[45] Date of Patent: Apr. 30, 1985

[54] SOCK WITH SIMULATED LACE EDGE AND METHOD

[75] Inventor: Chester L. Kearns, Star, N.C.

[73] Assignee: Montgomery Hosiery Mill, Inc., Star, N.C.

[21] Appl. No.: 562,978

[22] Filed: Dec. 19, 1983

[51] Int. Cl.[3] ..... D04B 9/46

[52] U.S. Cl. ..... 66/180; 66/41; 66/172 E; 66/172 R

[58] Field of Search ..... 66/180, 172 E, 172 R, 66/196, 178 R, 41, 92

[56] References Cited

U.S. PATENT DOCUMENTS

| | | | |
|---|---|---|---|
| 2,953,003 | 9/1960 | Crawford | 66/41 |
| 2,986,025 | 5/1961 | Cormier | 66/172 E |
| 3,003,343 | 10/1961 | Alfano | 66/180 |
| 3,013,420 | 12/1961 | Cormier | 66/180 |
| 4,034,580 | 7/1977 | Holder | 66/172 E |

*Primary Examiner*—Ronald Feldbaum
*Assistant Examiner*—Mary A. Ellis
*Attorney, Agent, or Firm*—Bell, Seltzer, Park & Gibson

[57] ABSTRACT

The single-ply decorative simulated lace edge of the sock of the present invention is formed by successively knitting first and second groups of tuck stitch loops each extending over multiple courses and while forming the second group of tuck stitch loops in spaced-apart wales which are offset relative to the wales in which the first group of tuck stitch loops are formed. The offset groups of tuck stitch loops cause the fabric to be drawn inwardly and the plain stitch loops therebetween are deformed inwardly to provide a checkerboardlike decorative pattern of alternating depressed fabric areas and tuck stitch loops. The first group of tuck stitch loops also draws the selvage makeup inwardly in those wales in which the tuck stitch loops are formed and provides a scalloped lower edge on the decorative edge portion. The upstanding and outwardly turned two-ply cuff is integrally knit at its lower edge so that the width of the cuff and the location of the single-ply decorative simulated lace edge remains the same during wear of the sock.

7 Claims, 4 Drawing Figures

SOCK WITH SIMULATED LACE EDGE AND METHOD

FIELD OF THE INVENTION

This invention relates generally to a sock with a simulated lace edge and method of knitting the same and more particularly to such a sock with a two-ply cuff and single-ply decorative simulated lace edge which is knit on a hosiery knitting machine containing a single set of needles.

BACKGROUND OF THE INVENTION

For many years it has been the practice to produce infants' socks by knitting a true rib cuff and then sewing a lace border or edge on the cuff to provide a decorative edge thereto. In recent years, this type of sock has also been manufactured in larger sizes for wear by girls and ladies. Since the lace border or edge must be sewn to the knit cuff of the sock in a separate operation, this necessarily increases the cost of producing this type of sock.

In order to eliminate this separate sewing operation, U.S. Pat. No. 3,003,343 discloses knitting a simulated lace edge integrally with the usual knitted cuff. While the sock disclosed in this patent does eliminate the separate step of sewing a lace border or edge to the cuff, this sock is produced on a hosiery knitting machine having both dial and cylinder needles and the true rib cuff is manually turned down during wear so that the simulated lace edge is positioned at the lower edge of the cuff and surrounds the ankle of the wearer. The cuff is turned so that the decorative simulated lace edge is positioned in the desired location around the ankle by the wearer. However, during wear, the position of the simulated lace edge may be changed by the cuff being turned to a greater or lesser amount so that the simulated lace edge may not remain in the desired position around the ankle.

SUMMARY OF THE INVENTION

With the foregoing in mind, it is an object of the present invention to provide a sock with an upstanding and outwardly turned two-ply cuff and a single-ply decorative simulated lace edge portion knit integrally with and extending downwardly from the lower edge of the two-ply cuff so that the width of the two-ply cuff and the position of the decorative edge around the ankle remains constant during wear.

It is another object of the present invention to provide a method of knitting this type of sock on a hosiery knitting machine having a single set of needles.

The sock of the present invention includes a decorative simulated lace edge with a purl side facing outwardly and a knit side facing inwardly, and a selvage makeup along the lower edge. A first group of tuck stitch loops extends over a first group of multiple courses and the tuck stitch loops are positioned in selected spaced-apart wales. Plain stitch loops are formed in the wales between the first group of tuck stitch loops. A second group of tuck stitch loops extends over a second group of multiple courses and is positioned in selected spaced-apart wales which are offset relative to the spaced-apart wales in which the first group of tuck stitch loops is formed. Plain stitch loops are also formed in the wales between the second group of tuck stitch loops. The first and second groups of tuck stitch loops draw the decorative edge portion together in a walewise direction and cause the plain stitch loops therebetween to be deformed inwardly to form a checkerboardlike decorative pattern of alternating depressed fabric areas and tuck stitch loops. The first group of tuck stitch loops also draws the selvage makeup inwardly in those wales in which the tuck stitch loops are formed to provide a scalloped lower edge on the decorative edge portion.

BRIEF DESCRIPTION OF THE DRAWINGS

Other objects and advantages will appear as the description proceeds when taken in connection with the accompanying drawings, in which.

DESCRIPTION OF THE ILLUSTRATED EMBODIMENT

Figure 1:
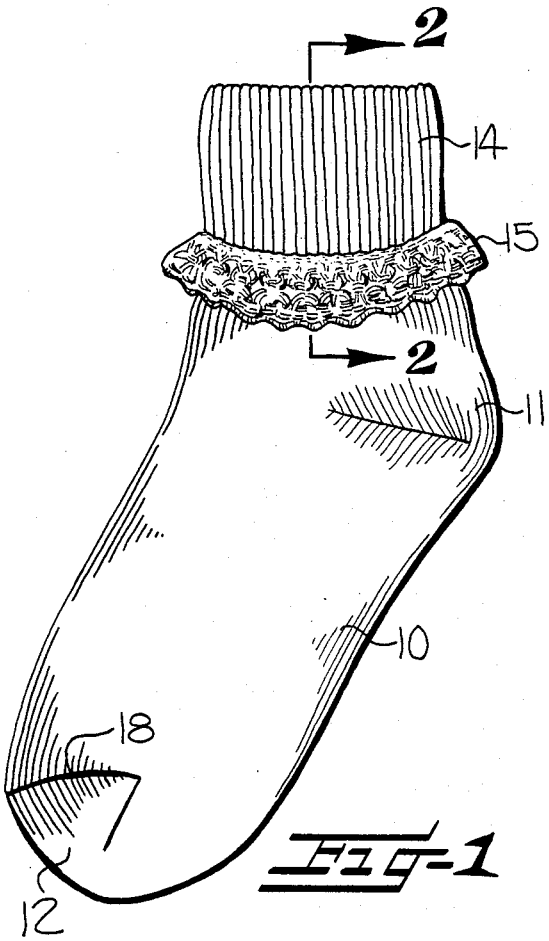
FIG. 1 is a side elevation of a sock provided with the two-ply cuff and single-ply decorative simulated lace edge in accordance with the present invention.
Figure 2:
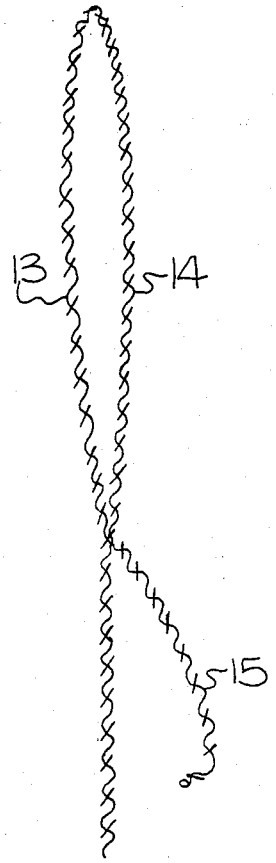
FIG. 2 is an enlarged vertical sectional schematic view taken substantially along the line 2—2 in FIG. 1.

As illustrated in FIG. 1, the sock of the present invention includes a conventional foot 10 having a heel 11 and toe 12. An upstanding and outwardly turned two-ply cuff is formed integrally with the upper edge of the leg or ankle portion of the sock and includes an inner ply 13 (FIG. 2) and an outer ply 14 which are integrally knit at their lower ends and joined by a fold line at their upper ends. A single-ply decorative simulated lace edge portion 15 is knit integrally with and extends downwardly from the lower edge of the two-ply cuff and includes a purl side facing outwardly, a knit side facing inwardly, and a selvage makeup along the lower edge. As will be noted in FIG. 2, the lower portion of the decorative edge 15 has a tendency to turn or curl inwardly and this aids in providing a somewhat lacy appearance thereto.

Figure 4:
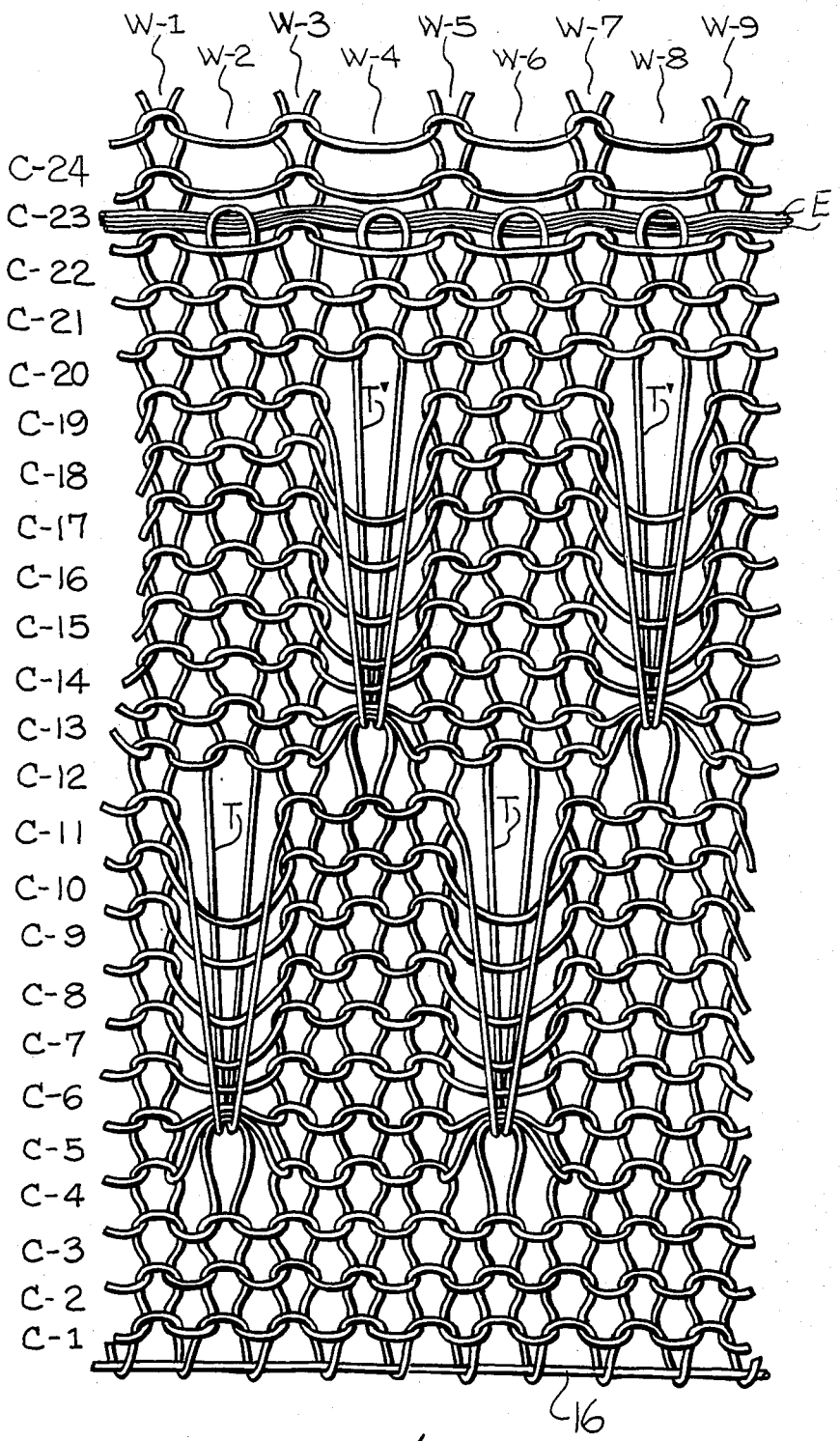
FIG. 4 is a greatly enlarged diagrammatic view illustrating the stitch construction of the decorative edge and showing the manner in which it is joined at the upper end to one ply of the two-ply cuff.

As illustrated in FIG. 4, the decorative edge 15 includes a selvage makeup which may be formed of one or more rounds of yarn 16, and a group of courses of plain stitch loops (courses C-1 through C-4) positioned adjacent the selvage makeup. A first group of tuck stitch loops, indicated at T, extends over a first group of multiple courses (courses C-5 through C-12). These tuck stitch loops T are positioned in selected spaced-apart wales (wales W-2 and W-6) and plain stitch loops are formed in the wales between the first group of tuck stitch loops T, as illustrated in wales W-3, W-4, and W-5.

A second group of tuck stitch loops, indicated at T', extends over a second group of multiple courses (courses C-13 through C-20). These tuck stitch loops T' are positioned in selected spaced-apart wales (wales W-4 and W-8) which are offset relative to the selected spaced-apart wales in which the first group of tuck stitch loops T is formed. Plain stitch loops are also formed in the wales between the second group of tuck stitch loops T', as illustrated in wales W-5, W-6 and W-7.

Figure 3:
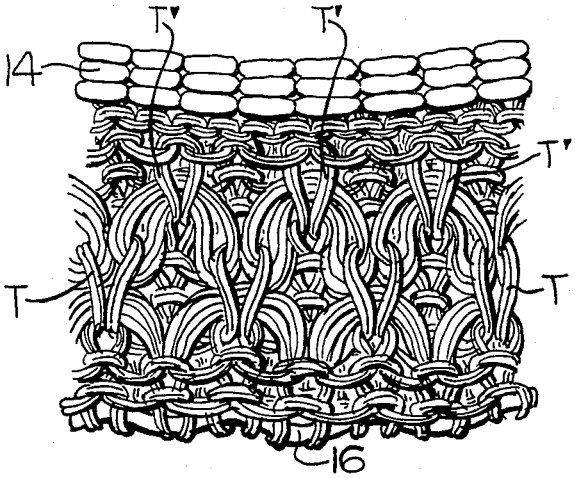
FIG. 3 is a greatly enlarged fragmentary elevational view of a small area at the junction of the single-ply decorative edge and the two-ply cuff.

The first and second groups of tuck stitch loops T and T' draw the decorative edge portion together in both walewise and coursewise directions and cause the plain stitch loops therebetween to be deformed inwardly to provide a checkerboardlike decorative pattern of alternating depressed fabric areas and tuck stitch loops, as illustrated in FIG. 3. Also, the first group of tuck stitch loops T draws the selvage makeup inwardly in those wales in which these tuck stitch loops T are formed to thereby provide a scalloped lower edge on the decorative edge portion 15, as illustrated in FIG. 3.

As illustrated in FIG. 4, the upper portion of the decorative simulated lace edge 15 includes plain knit courses C-21 and C-22 and the stitch loops on every other needle, those stitch loops in wales W-2, W-4, W-6 and W-8, are held on the needles and not cast off while the outer ply 14 and the inner ply 13 of the two-ply cuff are knit on the intervening needles, those needles which knit the wales W-1, W-3. W-5. W-7 and W-9. During the knitting of the final course of the decorative simulated lace edge 15, that is, course C-22, it is preferred that several rounds, for example, four rounds of elastic yarn E be inlaid or interlaced in the needles and held on those needles knitting the wales W-2, W-4, W-6 and W-8 during the knitting of the outer and inner plies 14, 13 of the two-ply cuff so that the latches of the needles will operate properly when these needles are again activated to knit the foot portion of the sock, in a manner to be presently described. The knitting of the the two-ply cuff on only every other needle, as illustrated in courses C-23 and C-24, causes the cuff to have a ribbed or walewise extending ribbed appearance, simulating a true rib cuff.

METHOD OF KNITTING

The sock of the present invention is knit on a conventional circular hosiery knitting machine having a single set of needles and knitting proceeds from the selvage makeup, through the decorative simulated lace edge portion 15, the outer ply 14, the inner ply 13 of the two-ply cuff, and through the foot 10 to the toe 12. The selvage makeup is formed by inlaying or interlacing one or more rounds of yarn 16, preferably a bulky Orlon, in alternate needles and then feeding the body yarn to all needles to form the course C-1 with the sinker loops encircling the inlaid makeup yarn 16. The body yarn is then knit on all needles to form plain stitch loops in the courses C-2, C-3 and C-4 and the stitch loops are held on the needles in wales W-2 and W-6 of course C-4.

In courses C-5 through C-11, plain stitch loops are formed in all wales except wales W-2 and W-6 where the yarn is merely placed in the hook of the needle but stitch loops are not formed to form tuck loops extending across these wales. In course C-12, the body yarn is fed to and forms stitch loops on all needles so that the elongated tucks T are formed in the wales W-2 and W-6 while plain stitch loops are formed in the remaining wales. In this course C-12, the stitch loops in wales W-4 and W-8 are held in the hooks of the needles and the body yarn is fed to but does not form stitch loops in the wales W-4 and W-8 during the knitting of the courses C-14 through C-19 and plain stitch loops are formed in the remaining wales.

The body yarn is fed to all needles and forms stitch loops in the knitting of course C-20 to form the elongated tuck stitch loops T' in wales W-4 and W-8. Courses C-21 and C-22 are knit with plain stitch loops in every wale while the stitch loops are held on the needles in the wales W-2. W-4, W-6 and W-8 of course C-22 until after both the outer ply 14 and inner ply 13 of the two-ply cuff have been knit on the remaining wales. During the knitting oi course C-23. one or more rounds, preferably four rounds of elastic yarn E are inlaid on the alternate needles so that this elastic yarn passes in front of the stitch loops in the odd-numbered wales while passing on the inside of the needles holding the stitch loops in the even-numbered wales. This elastic yarn is inlaid in the needles at this point so that the latches of the inactive needles will be operated when these inactive needles in wales W-2, W-4, W-6 and W-8 are again activated to knit the foot of the sock.

The desired number of courses are knit, in the manner illustrated by courses C-23 and C-24, to form the desired length of the outer ply 14 and the inner ply 13 of the turned cuff. Upon completion of the knitting of the last course on the odd-numbered needles of the inner ply 13, the leg and foot portion of the sock are knit by feeding the body yarn to all needles and so that stitch loops are also formed on the needles which have been holding the stitch loops in wales W-2, W-4, W-6 and W-8 and this automatically integrally knits and joins the two lower edges of the outer ply 14 and the inner ply 13 as well as the upper edge of the decorative simulated lace edge portion 15 to the plain leg or ankle courses above the heel pocket 11. The foot of the sock is then knit in any desired manner, preferably with plain stitch loops and the sock is removed from the knitting machine with the usual toe opening therein. The toe opening is then closed by a closure seam or looper line 18 and the sock is completed, except for finishing and boarding, if desired.

The sock of the present invention is thus economically knit on a conventional-type circular hosiery knitting machine which includes only a single set of needles. The separate groups of tuck stitch loops are offset, relative to each other, and cause the fabric to be drawn inwardly in both walewise and coursewise directions so that the plain stitch loops therebetween are deformed inwardly and provide a checkerboardlike decorative pattern of alternating depressed fabric areas and tuck stitch loops with the first group of tuck stitches causing the selvage makeup to draw inwardly and provide a scalloped lower edge on the decorative edge portion.

In the drawings and specification there has been set forth the best mode presently contemplated for the practice of the present invention, and although specific terms are employed, they are used in a generic and descriptive sense only and not for purposes of limitation, the scope of the invention being defined in the claims.

That which is claimed is:

1. A sock including a foot, an upstanding and outwardly turned two-ply cuff, and a single-ply decorative simulated lace edge portion knit integrally with and extending downwardly from the lower edge of said two-ply cuff, a plurality of rounds of elastic yarn inlaid in the first course of said two-ply cuff said decorative edge portion including a plurality of successive courses forming adjacent wales of stitch loops, a purl side of all of said stitch loops facing outwardly, a knit side of all of said stitch loops facing inwardly, a selvage makeup along the lower edge, a first group of tuck stitch loops extending over a first group of multiple courses and being positioned in selected spaced-apart wales, plain stitch loops formed in the wales between said first group of tuck stitch loops, a second group of tuck stitch loops extending over a second group of multiple courses and being positioned in selected spaced-apart wales which are offset relative to said selected spaced-apart wales in which said first group of tuck stitch loops are formed, and plain stitch loops formed in the wales between said second group of tuck stitch loops, said first and second groups of tuck stitch loops drawing said decorative edge portion together in a walewise direction and causing said plain stitch loops therebetween to be deformed inwardly and forming a checkerboardlike decorative pattern of alternating depressed fabric areas and tuck stitch loops, and said first group of tuck stitch loops drawing said selvage makeup upwardly in those wales in which said tuck stitch loops are formed and providing a scalloped lower edge on said decorative edge portion.

2. A sock according to claim 1 wherein said single-ply decorative edge portion includes a group of courses of plain stitch loops positioned between said selvage makeup and said first group of tuck stitch loops.

3. A sock according to claim 2 wherein said group of courses of plain stitch loops comprises four courses.

4. A sock according to claim 1 wherein said tuck stitch loops of said first and second groups extend over eight courses.

5. A sock according to claim 4 wherein said tuch stitch loops of said first and second groups are formed in every fourth wale with three wales of plain stitch loops therebetween.

6. A method of knitting a sock on a knitting maching including only a single set of needles and including a single-ply decorative edge portion integrally knit with and extending downwardly from an upstanding and outwardly turned two-ply cuff, said method comprising the steps of knitting a selvage makeup, knitting a plurality of successive courses on all of the needles while forming a first group of tuck stitch loops extending over said first group of courses and being positioned in selected spaced-apart wales, knitting a second group of successive courses on all of the needle while forming a second group of tuck stitch loops extending over said second group of multiple courses and being positioned in selected spaced-apart wales which are offset relative to the selected spaced-apart wales in which said first group of tuck stitch loops are formed to complete the single-ply decorative simulated lace edge portion interlacing elastic yarn on the needles knitting the last course of the single-ply decorative edge portion, holding the interlaced elastic yarn in the interventing wales while knitting the inner and outer plies of the two-ply cuff, knitting a third group of successive courses on only alternate needles while forming stitch loops in alternate wales only and holding the stitch loops of intervening wales an intervening needles to form the outwardly turned two-ply cuff with inner and outer plies, and knitting on all needles to join the inner and outer plies of said two-ply cuff, and knitting successive courses of plain fabric on all needles to form the leg and foot of the sock.

7. A method of knitting a sock according to claim 6 including the step of knitting a plurality of plain courses after knitting the selvage makeup and prior to knitting the first group of tuck stitch loops.

* * * * *